United States Patent [19]

Black et al.

[11] Patent Number: 4,478,128

[45] Date of Patent: Oct. 23, 1984

[54] PROJECTILE CARRIER FOR LIQUID PROPELLANT GUN

[75] Inventors: William L. Black, China Lake, Calif.; Kenneth L. Moore, Silver Spring, Md.

[73] Assignee: The United States of America as represented by the Secretary of the Navy, Washington, D.C.

[21] Appl. No.: 262,351

[22] Filed: May 11, 1981

[51] Int. Cl.[3] ..... F41F 1/04; F42B 5/16; F42B 5/36

[52] U.S. Cl. ..... 89/7; 102/440; 102/470

[58] Field of Search ..... 102/440, 470, 527; 89/7

[56] References Cited

U.S. PATENT DOCUMENTS

| | | | |
|---|---|---|---|
| 855,958 | 6/1907 | Loeble | 102/470 |
| 2,809,587 | 10/1957 | Musser | 102/527 |
| 2,947,221 | 8/1960 | Griffin et al. | 89/7 |
| 2,960,031 | 11/1960 | Clift | 102/440 X |
| 3,011,451 | 12/1961 | Griffin | 89/7 X |
| 3,455,202 | 7/1969 | Dixon et al. | 89/7 |
| 3,516,357 | 6/1970 | Hendricks | 102/470 |
| 3,732,820 | 5/1973 | Hendricks | 102/470 |
| 3,763,739 | 10/1973 | Tassie | 89/7 |
| 3,782,241 | 1/1974 | Ashley | 89/7 |
| 3,803,975 | 4/1974 | Elmore et al. | 89/7 |
| 3,888,159 | 6/1975 | Elmore et al. | 89/7 |
| 3,890,902 | 6/1975 | Travor et al. | 102/518 X |
| 3,992,976 | 11/1976 | Bartels et al. | 89/7 |
| 4,011,817 | 3/1977 | Ashley | 102/440 |
| 4,063,486 | 12/1977 | Ashley | 102/440 X |
| 4,102,269 | 7/1978 | Ashley | 102/440 |
| 4,161,133 | 7/1979 | Black et al. | 89/7 |
| 4,333,383 | 6/1982 | Stansbury et al. | 89/7 |

*Primary Examiner*—David H. Brown

*Attorney, Agent, or Firm*—Robert F. Beers; W. Thom Skeer

[57] ABSTRACT

This invention concerns an improved round for use in liquid propellant guns. The improved round comprises a projectile attached to a carrier which is shaped like an abbreviated cartridge case. The carrier has a plurality of injection ports that communicate to an expandable volume. Sealing means prevent the escape of liquid propellant from the expandable volume which upon injection causes the projectile to be pumped to a forcing cone leaving the carrier behind. Several ignition means are used employing Boxer, Berdan or electric primers.

9 Claims, 6 Drawing Figures side of disk 23 opposite primer 21 is coated with an elastomer seal 24 which prevents liquid from wetting primer 21. Elastomer seal 24 also serves to prevent moisture from invading primer 21 when it is stored since injection ports 112 allow easy passage. A primer flash hole 25 communicates between primer cavity 22 and expandable volume 18.

FIG. 2B illustrates ignition means 20 having a primer 28, a Berdan primer, primer flash holes 25, and plugs 27. Disk 23 can be eliminated as illustrated in FIGS. 2B, 2C, and 2D. Berdan primer has a cup, and ignition mix 211. Anvil 213 is an integral part of carrier 11. Primer flash holes 25 in FIG. 2B are blocked by plugs 27 having plug cap 271 for controlling the depth of insertion of plugs 27.

In FIG. 2C, primer flash hole 25 stops short of expandable volume 18. Upon ignition of primer 21, a membrane 26 ruptures.

In FIG. 2D, plug 27 blocks primer flash hole 25. Plug 27 can be made of elastomer type material. Multiple primer flash holes can be used in all configurations illustrated.

Projectile 10 is designed for use in liquid propellant guns. A projectile seal 102 is securely held in place about a circumference of projectile 10. Seal 102 can be an elastomer material and it must prevent the flow of liquid past it. Rotating band 101 securely holds seal 102 in position and further engages riflings. Multiple projectile seals may be required for an efficient barrier to the high pressure liquid propellants.

In operation, carrier 11 and projectile 10, attached together, are automatically fed from a magazine, not shown, to a breech and positioned in front of bolting means 12. Bolting means 12 drives carrier 11 and projectile 10 into an injection position shown in FIG. 1A. During this phase extractor means 13 retractably secures itself to extractor groove 114. Bolting means 12 drives carrier 11 into injection valve means 15 with sufficient force so that sealing means 111 forms a hydraulic seal thereto.

Referring to FIG. 1B, liquid propellant is forced through injection annulus 16. If a solution monopropellant is used, only one annulus is necessary. If a bi-propellant is used two annuli are used. Injection valve means 15 is well known in the art. A compressible ullage existing in expandable volume 18 is totally mixed with liquid propellant and forms ullage bubbles 162 in expandable volume 18. Under continued liquid pressure, projectile 10 is forced from the front end of carrier 11 and travels along combustion chamber 17 until rotating band 101 contacts a forcing cone 171.

Before ignition means 20 ignites the propellant, bolting means 12 in cooperation with injection valve means 15 jogs a short distance closing the injection annulus as illustrated in FIG. 1B. This short jog further compresses the ullage volume. The controlled ullage volume is normally compressed to less than 50% of its initial volume. It has been found that a certain amount of ullage is necessary in the operation of a liquid bi-propellant gun.

Once injection annulus 16 is closed, firing pin 14 makes intimate contact with ignition means 20 thereby transferring ignition to the propellant. Shortly thereafter, bolting means 12 and extractor means 13 remove carrier 11. Also injection valve means 15 opens injection annulus 16. At this point a complete cycle has been performed. Variations in this operation are possible.

Thus, it is intended that the invention not be limited to the illustrative embodiments disclosed but limited solely by the language of the appended claims with full range of equivalents.

We claim:

1. An improved round for use in a liquid propellant gun comprising:

a projectile; and an abbreviated carrier including a body having an open front end dimensioned to provide frictional engagement with said projectile for receiving said projectile and a rear end;

a plurality of injection ports located about a circumference, said ports communicating to an expandable volume between said body rear end and said projectile;

sealing means for preventing the escape of propellant to a breech, located between said injection ports and said rear end of said body;

an extractor groove located proximally to said rear end between said sealing means and said rear end;

a primer cavity located in said rear end of said body;

a primer flash hole formed in said body, located between said primer cavity and said expandable volume for communicating therebetween; and ignition means for igniting liquid propellant located within said primer cavity.

2. An improved round according to claim 1, wherein said plurality of injection ports of said carrier are circular holes formed in said body, located about circumferences of said carrier.

3. An improved round according to claim 1, wherein said projectile has elastomer seal to prevent escape of liquid propellant into a barrel.

4. An improved round according to claim 3, wherein said projectile has a rotating band into which said elastomer seal is attached, said band being made of malleable material so as to adapt to riflings in a barrel upon ignition of said round.

5. An improved round according to claim 1, wherein said ignition means of said carrier comprises a primer and sealing means.

6. An improved round according to claim 5, wherein said primer is selected from the group consisting of standard Boxer, Berdan, or electric primers.

7. An improved round according to claim 5, wherein said sealing means is a metal disk with an elastomer coating on a side, securely positioned in a bottom of said primer cavity of said carrier, with the elastomer coating facing away from said primer.

8. An improved round according to claim 5, wherein said sealing means includes at least one rupturable membrane blocking said primer flash hole, said membranes located in said primer flash holes nearest said expandable volume.

9. An improved round according to claim 5 wherein said sealing means are elastomer plugs having caps secured in said primer flash holes.

* * * * *

PROJECTILE CARRIER FOR LIQUID PROPELLANT GUN

BACKGROUND OF THE INVENTION

1. Field of the Invention

This invention pertains to a liquid propellant gun, and, in particular, it pertains to a projectile carrier used in the liquid propellant gun.

2. Description of the Prior Art

In order to obtain a sustained high rate of fire, liquid propellant guns offer several advantages over conventional solid propellant guns. One advantage is the reduction in the inertia of one round of ammunition, and another is the cleaner and cooler burning characteristics of liquid propellants.

One technique of operating a liquid propellant gun (LPG) consists of loading a projectile into a breech, injecting a liquid propellant into a chamber behind the projectile, and igniting the propellant. The ignition means is usually mounted in a bolting device, and as a result, the same ignition means is repeatedly used for each projectile and this results in fouling if a sustained firing rate is attempted. One might attempt to avoid this problem by using a compression ignition means instead. This technique requires a compression-combustion chamber which is sufficiently pneumatically sealed to be capable of permitting enough compression to ignite the propellant and prevent mis-direction of the high pressure produced by the ignition. These requirements cause alternative problems.

Another technique is attaching to the projectile a carrier having the ignition means incorporated therein so that a new ignition means is provided for each round. In one device, the carrier is removed before ignition. Although this device eliminates the problem noted above, a more flexible design is desired.

SUMMARY OF THE INVENTION

This invention is directed to a projectile carrier used in liquid propellant guns.

The carrier is press-fitted onto the rear of the projectile and is shaped essentially like an abbreviated cartridge case. A plurality of holes, injection ports, are located about a circumference and communicate with a void formed between the carrier and the projectile. Sealing means are located about a circumference of the projectile and about a circumference of the carrier so as to confine injected propellants therebetween.

In operation, the carrier and projectile are fed into a breech where bolting means cause the round to be loaded into an injection position where propellants are injected. The propellants injected by injection means cause the projectile to be pumped into contact with the forcing cone. Thereafter, the bolting means moves the carrier forward to close-off injection means. The ignition means ignites the propellant upon command. The carrier is extracted by the bolting means. The above operation is repeated in a like manner.

One object of this invention is a projectile carrier for holding the projectile during feeding and having the ignition means therein.

Another object is a projectile carrier and projectile having sealing means for confining the propellants to a defined volume.

Another object is a projectile carrier having injection ports therein to direct the flow of the propellants into the carrier.

Another object is a projectile carrier having a controlled amount of ullage.

A still further object is a projectile which is separated from the carrier by propellant injection pressure.

These and many other objects and advantages of the present invention will be readily apparent to one skilled in the art to which the invention pertains from a perusal of the claims and of the following detailed description of a preferred embodiment of the invention when read in conjunction with the drawings.

BRIEF DESCRIPTION OF THE DRAWINGS

FIG. 2 is a series of section elevations of the ignition means within a portion of the carrier. Each

DESCRIPTION OF THE PREFERRED EMBODIMENT

Figure 1A:
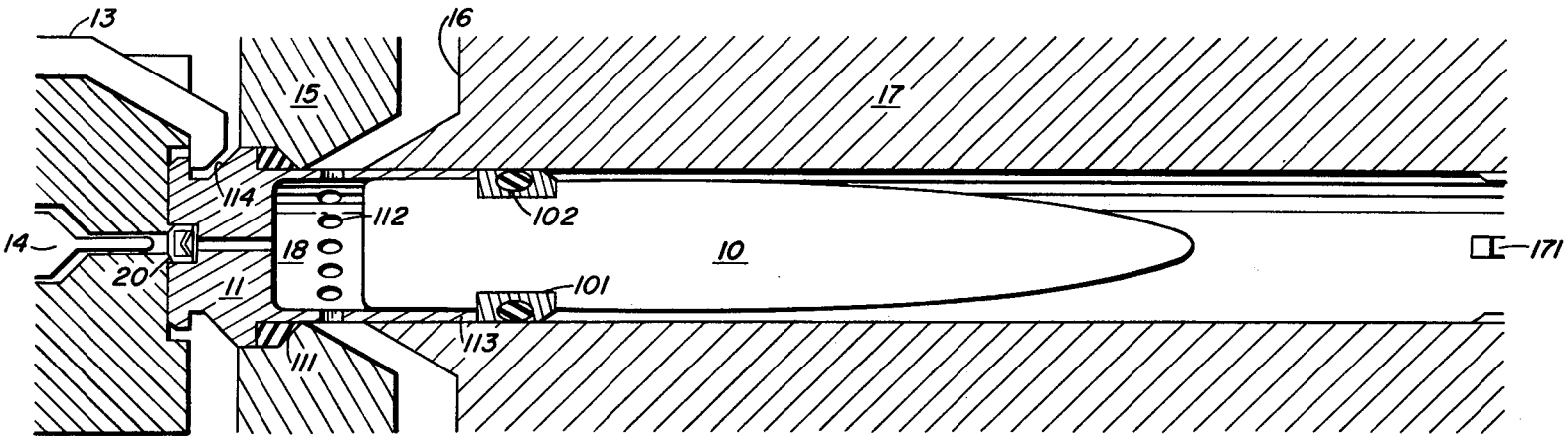
FIG. 1A is a section elevation of the carrier and projectile in the injection position.
Figure 1B:
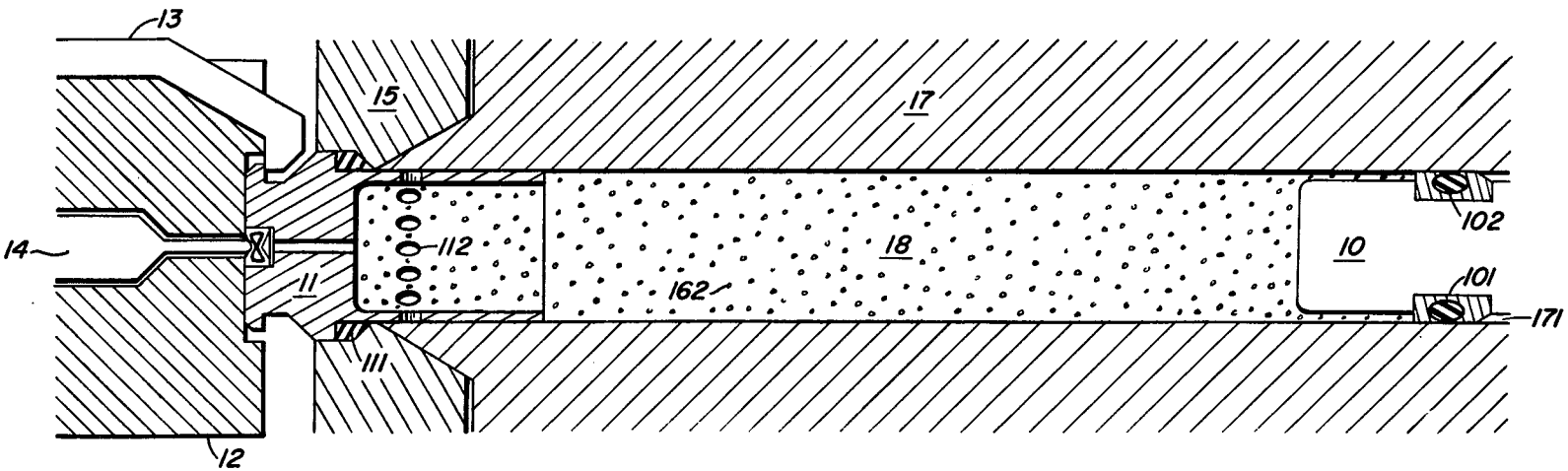
FIG. 1B is a section elevation of the carrier and projectile in the ignition position.
Figure 2A:
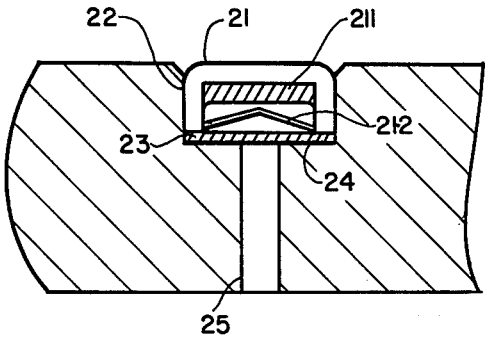
FIG. 2A to 2D, illustrates a different embodiment.
Figure 2B:
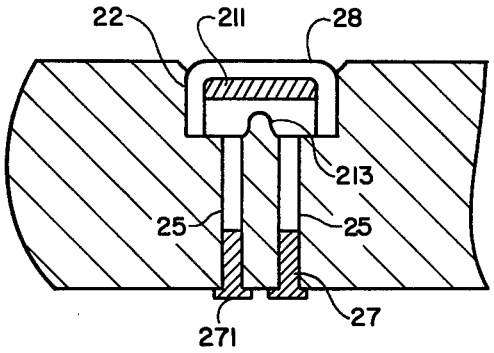
Figure 2C:
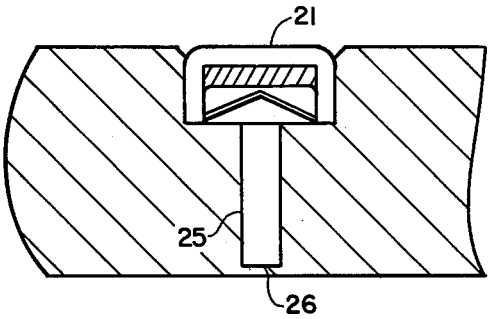
Figure 2D:
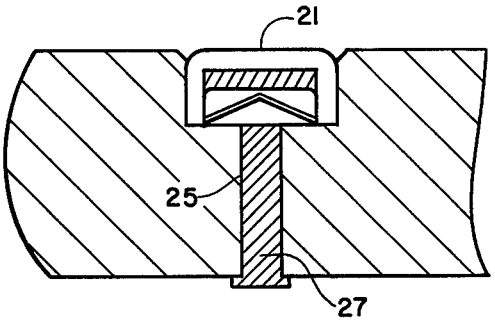

Referring to FIG. 1A, this illustrates a carrier 11 and a projectile 10, an improved round, in a propellant injection position.

Carrier 11 is composed of a body 113, injection ports 112, a seal 111, an extractor groove 114 located about a circumference of carrier 11, and ignition means 20.

Body 113 is shaped like an abbreviated casing for a normal projectile with new features disclosed by this invention. Projectile 10 is press-fitted into the open end of carrier 11. The amount of pressure needed to eject the projectile from carrier 11 must overcome the adherent force therebetween.

Injection ports 112 are located about a circumference of body 113 and communicate with expandable volume 18 initially being compressible ullage. Injection ports 112 are normally circular holes in body 113. The number of injection ports 112 and the area of the opens are normally dependent upon the mixing severity desired in a bi-propellant system. If a bi-propellant is used, injection ports 112 are located about two circumferences. An oxidizer injection annulus feeds one set of ports and a fuel injection annulus feeds the other set of ports. The number can be varied but the area must remain constant so as not to obstruct injection rates. The proportion of fuel to oxidizer is controlled by propellant injection means Sealing means 111 is located about a circumference of carrier 11 between said ignition means 20 and injection ports 112. Sealing means 111 can be an elastomer seal secured to carrier 11 by conventional means. Sealing means 111 forms a hydraulic seal between carrier 11 and an injection valve means 15. This seal prevents the escape of liquid to a breech, not shown.

A conventional extractor groove 114 is located on a rear end of carrier 11.

Further, ignition means 20 can be of conventional design using a standard Boxer primer or a Berdan, or electronic ignition.

Referring to FIGS. 2A to 2D, these illustrate possible variations. Primer 21, a Boxer primer, is securely press-fitted in a primer cavity 22. Primer 21 is composed of a cup, an ignition mix 211, and an anvil 212. At the bottom of primer cavity 22, a disk 23 is securely fitted. The